US011422490B2

(12) United States Patent
Endo et al.

(10) Patent No.: US 11,422,490 B2
(45) Date of Patent: Aug. 23, 2022

(54) IMAGE FORMING APPARATUS WITH CONTROLLED OPERATION FOR AIR SUCTION

(71) Applicant: Canon Kabushiki Kaisha, Tokyo (JP)

(72) Inventors: Michiaki Endo, Chiba (JP); Tomoharu Kitajima, Ibaraki (JP); Shuhei Takahashi, Chiba (JP); Shuichi Tamura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/126,641

(22) Filed: Dec. 18, 2020

(65) Prior Publication Data

US 2021/0109466 A1 Apr. 15, 2021

Related U.S. Application Data

(63) Continuation of application No. PCT/JP2019/025263, filed on Jun. 19, 2019.

(30) Foreign Application Priority Data

Jun. 21, 2018 (JP) ..... JP2018-117841

(51) Int. Cl.
*G03G 15/20* (2006.01)

(52) U.S. Cl.
CPC ..... *G03G 15/2028* (2013.01); *G03G 15/2098* (2021.01)

(58) Field of Classification Search
CPC ..... G03G 15/2028; G03G 15/2098
See application file for complete search history.

(56) References Cited

U.S. PATENT DOCUMENTS

| | | | | |
|---|---|---|---|---|
| 4,412,738 | A | 11/1983 | Ahern et al. | |
| 7,480,480 | B2 | 1/2009 | Endo et al. | 399/329 |
| 7,505,725 | B2 | 3/2009 | Katayama et al. | 399/329 |
| 7,546,078 | B2 | 6/2009 | Okuda et al. | 399/329 |
| 8,838,000 | B2 | 9/2014 | Tamura | 399/328 |
| 9,223,263 | B2 | 12/2015 | Endo | G03G 15/2028 |
| 9,250,586 | B2 | 2/2016 | Endo | G03G 15/206 |
| 9,823,616 | B2 | 11/2017 | Endo | G03G 15/80 |
| 2007/0268355 | A1 | 11/2007 | Sato | |
| 2009/0233211 | A1 | 9/2009 | Takahashi et al. | |
| 2014/0210155 | A1 | 7/2014 | Satake | |
| 2017/0185014 | A1 | 6/2017 | Komatsu | G03G 15/20 |
| 2019/0011850 | A1 | 1/2019 | Takahashi | |

(Continued)

FOREIGN PATENT DOCUMENTS

| | | | |
|---|---|---|---|
| JP | 2001071617 A | * | 3/2001 |
| JP | 2001-305937 A | | 11/2001 |

(Continued)

OTHER PUBLICATIONS

JP_2001071617_A_I MachineTranslation, Japan, Sato, 2001.*

(Continued)

*Primary Examiner* — Victor Verbitsky
(74) *Attorney, Agent, or Firm* — Venable LLP

(57) ABSTRACT

An infrared irradiating portion is turned on in accordance with power-on of an image forming apparatus 10, and an air sucking operation of an air sucking portion 300 is started after a temperature of an infrared radiation member 305 of an IR irradiating portion 13 reaches a predetermined temperature.

5 Claims, 10 Drawing Sheets

[FIG9]

(56) References Cited

U.S. PATENT DOCUMENTS

| | | | | |
|---|---|---|---|---|
| 2020/0150569 | A1 | 5/2020 | Yashiro et al. .... | G03G 15/2057 |
| 2020/0166877 | A1 | 5/2020 | Tamura et al. .... | G03G 15/2053 |

FOREIGN PATENT DOCUMENTS

| | | | | | |
|---|---|---|---|---|---|
| JP | 2001305937 | A | * | 11/2001 | |
| JP | 2007-29582 | A | | 2/2007 | |
| JP | 2007-307738 | A | | 11/2007 | |
| JP | 2009-222896 | A | | 10/2009 | |
| JP | 2009-222897 | A | | 10/2009 | |
| JP | 2010-096953 | A | | 4/2010 | |
| JP | 2014-166918 | A | | 9/2014 | |
| JP | 2014166918 | A | * | 9/2014 | ..... B41J 11/007 |
| JP | 2017-120377 | A | | 7/2017 | |
| JP | 2017-187739 | A | | 10/2017 | |

OTHER PUBLICATIONS

JP_2014166918_A_I MachineTranslation, Japan, Satake, 2014.*
International Search Report, dated Sep. 24, 2019, in International Application No. PCT/JP2019/025263.
Office Action dated Mar. 15, 2022 in counterpart Japanese Application No. 2018-117841, together with English translation thereof.

* cited by examiner

IMAGE FORMING APPARATUS WITH CONTROLLED OPERATION FOR AIR SUCTION

CROSS-REFERENCE TO RELATED APPLICATIONS

This application is a continuation of International Patent Application No. PCT/JP2019/025263, filed Jun. 19, 2019, which claims the benefit of Japanese Patent Application No. 2018-117841, filed Jun. 21, 2018. The foregoing applications are incorporated herein by reference in their entireties.

TECHNICAL FIELD

The present invention relates to an image forming apparatus including a fixing device in which an infrared irradiating device for auxiliary fixation or fixation of an unfixed image, prepared by an image forming portion, on a recording material heated through infrared irradiation.

BACKGROUND ART

For example, in the image forming apparatus using an electrophotographic process of a transfer type, a toner image prepared by an image forming portion is transferred onto a recording material (hereinafter, referred to also as a sheet) by a transfer device, and the sheet on which the toner image is transferred is fed (conveyed) to a fixing device. Then, the sheet on which an unfixed toner image is placed passes through a fixing nip formed from a fixing member and a pressing member which are provided in the fixing device. A fixing type such that in a process thereof, heating and pressing are carried out at the same time and the toner image is fixed on the sheet has been employed in general. The fixing member and the pressing member are principally constituted by a roller or a belt, and a heating member is provided inside the fixing member and the pressing member in many instances.

In the above-described fixing type, the unfixed toner image is press-contacted to the fixing member by the pressing member, so that heating and pressing of the toner are carried out at the same time, and therefore, a curl or a crease such that the sheet itself is deformed depending on a water content and rigidity possessed by the sheet itself during passing through the fixing nip occurs in some instances.

Further, when a fixing temperature of the fixing member is made excessively high, a problem of a high-temperature offset phenomenon that the toner is excessively melted and cohesion between toners lowers and is melted on the fixing member and is taken by the fixing member side arises. Particularly during passing of a sheet with a small width a temperature of the fixing member increases at a portion of the fixing member where the sheet does not contact the fixing member. This phenomenon is called non-sheet-passing portion temperature rise. Thereafter, in the case where a sheet with a width larger than the width of a preceding sheet, the high-temperature offset phenomenon occurs in some instances.

Therefore, a proposal which pays attention to solution of the above-described fixing offset problem has also been made. In Japanese Laid-Open Patent Application (JP-A) 2007-29582, a device constitution in which although the unfixed toner image is passed through the fixing nip constituted from the fixing member and the pressing member, a heat source is not provided inside the fixing member and the pressing member, but is disposed upstream thereof has been described. This is intended to solve the fixing offset problem by separating functions of the heating and the pressing. As the heat source thereof, an infrared irradiating device capable of irradiating infrared radiation is used.

In JP-A 2009-222897, a device constitution employing a light irradiation fixing (flash fixing) capable of fixing the unfixed toner image on the sheet by the pressing member has been described. This is a proposed which pays attention to, in addition to the above-described fixing high-temperature offset problem, problem solving of the curl and the crease of the sheet itself after passing through the fixing device, provision for special sheets such as a seal material and an envelope, and further, ultrahigh-speed printing which is impossible in the nip between the fixing member and the pressing member. For light irradiation, for-infrared irradiating device capable of irradiating far-infrared radiation is used.

In Japanese Patent Application No. 2017-7790, an image forming apparatus in which a liquid developer curable by ultraviolet radiation is used for ensuring a fixing property and in which an ultraviolet irradiating device for fixing the liquid developer on a recording material is provided has been described. This pays attention to a problem such that in the case where further speed-up is intended, the fixing property cannot be sufficiently ensured only by the light irradiation using the infrared radiation. By a fixing device using the ultraviolet irradiating device, the liquid developer is capable of being cured instantaneously and is used for drying or the like in a high-speed UV offset printing machine or a UV ink jet printing machine.

Problem to be Solved by the Invention

In order to realize speed-up and image quality improvement of the image forming apparatus as in the fixing devices described in JP-A 2007-29582, JP-A 2009-222896 and Japanese Patent Application No. 2017-7790, there is a need that the fixing devices including the infrared irradiating device or including the infrared irradiating device and the ultraviolet irradiating device in combination feed the recording material, on which the unfixed toner image is placed, to a fixing portion. As a recording material feeding device, one utilizing air suction and one utilizing electrostatic attraction would be considered, but the air suction is effective. This is because in the case where an electrostatic means is used, a possibility that the unfixed toner image on the recording material is disturbed would be considered.

However, in the case of using the arrow, there arose the following problem. That is, the infrared irradiating device has to reach a certain temperature for exhibiting ability thereof. However, an effect of cooling the infrared irradiating device is generated by carrying out the air suction at a recording material feeding portion, so that particularly during a stand-by operation (during rising) of the image forming apparatus, there was a problem that a stand-by time (warm-up time) is prolonged.

Therefore, an object of the present invention is to provide an image forming apparatus capable of shortening the stand-by time by solving the above-described problem.

Means for Solving the Problem

According to an aspect of the present invention, there is provided an image forming apparatus comprising: an image forming portion for forming an unfixed image on a recording material; a recording material feeding mechanism including a rotatable endless belt having air permeability and an air suction portion which is provided inside the belt and which imparts negative pressure, through the belt, for sucking and holding the recording material on the belt, wherein the recording material feeding mechanism feeds the recording material on which the unfixed image is formed by the image forming portion, while sucking and holding the recording material on the belt; an infrared irradiating portion, provided opposed to a belt portion of the belt on a recording material feeding side, for heating the image by irradiating the recording material fed while being sucked and held on the belt, with infrared radiation; and a controller for controlling operations of the recording material feeding mechanism and the infrared irradiating portion, wherein the controller turns on the infrared irradiating portion in accordance with power-on of the image forming apparatus and causes the air suction portion to start an air sucking operation after a temperature of an infrared radiation member of the infrared irradiating portion reaches a predetermined temperature.

Further features of the present invention will become apparent from the following description of exemplary embodiments with reference to the attached drawings.

EMBODIMENTS FOR CARRYING OUT THE INVENTION

In the following, preferred embodiments of the present invention will be described on the basis of the attached drawings by taking, as an example, an image forming apparatus in which ultraviolet curing fixing is carried out by using a liquid developer containing a liquid carrier of an ultraviolet curable type and toner.

Embodiment 1

(General Structure of Image Forming Apparatus)

Figure 1:
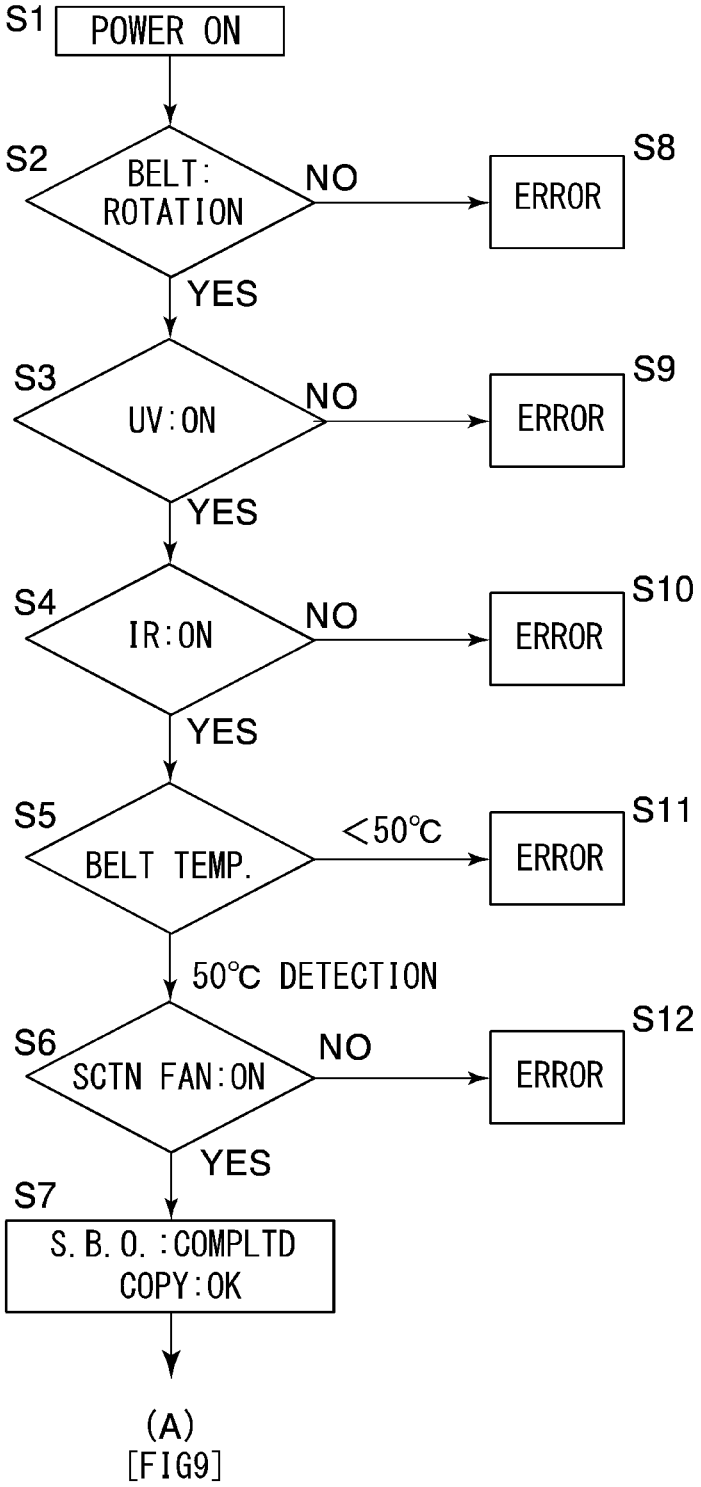
FIG. 1 is a flowchart of a stand-by operation of a fixing portion in an embodiment 1.
Figure 2:
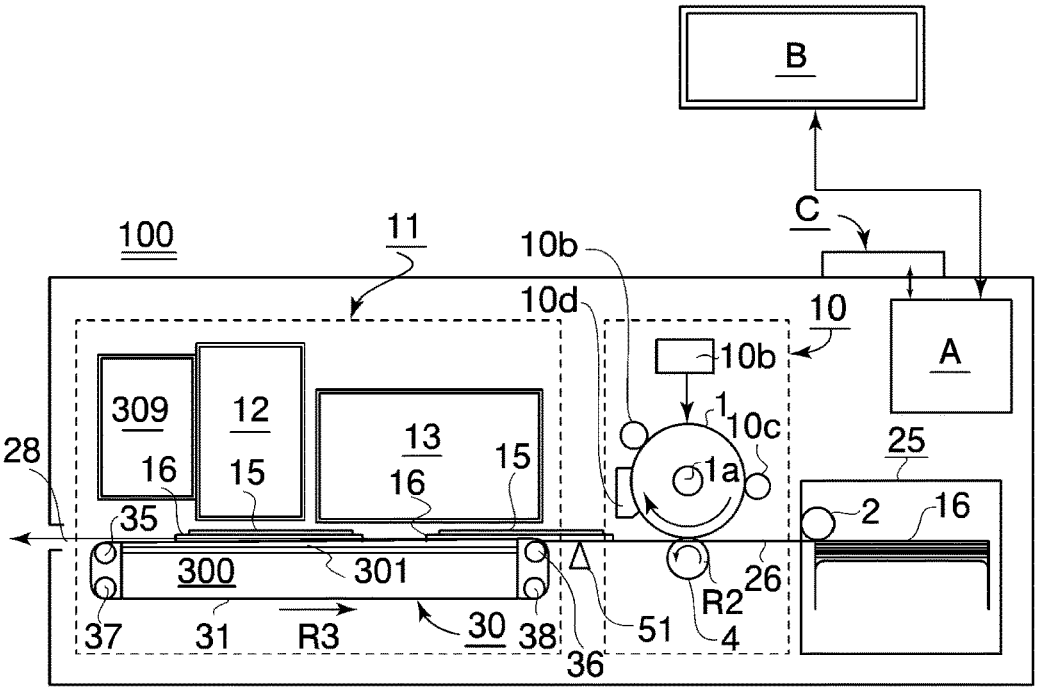
FIG. 2 is a schematic longitudinal front view of an image forming apparatus in the embodiment 1.

FIG. 2 is a schematic longitudinal front view of an image forming apparatus 100 in an embodiment 1. In the following description, a front surface (front, front side) of the image forming apparatus 100 is a front side in a drawing sheet surface of FIG. 1, and a rear surface (rear, rear side) is a side opposite thereto. Left and right are left and right when the apparatus 100 is seen from the front surface. Up and down are up and down in the direction of gravitation. An upstream side and a downstream side are an upstream side and a downstream side in a recording material feeding direction. Further, ultraviolet radiation is referred to as UV or UV light, and infrared radiation is referred to as IR or IR light.

This image forming apparatus 100 is a printer urging an electrophotographic process of a transfer type. That is, the apparatus 100 carries out toner image formation on a recording material 16 by performing an image forming operation on the basis of an image forming job (print job) is put in (inputted to) a controller (control circuit portion) A from a host device B such as a personal computer. The image forming job is an image forming instruction to which pieces of print condition information such as first data, information on a kind or the like of the recording material used, the number of sheets, the number of copies, post-process information and the like are added.

Figure 4:
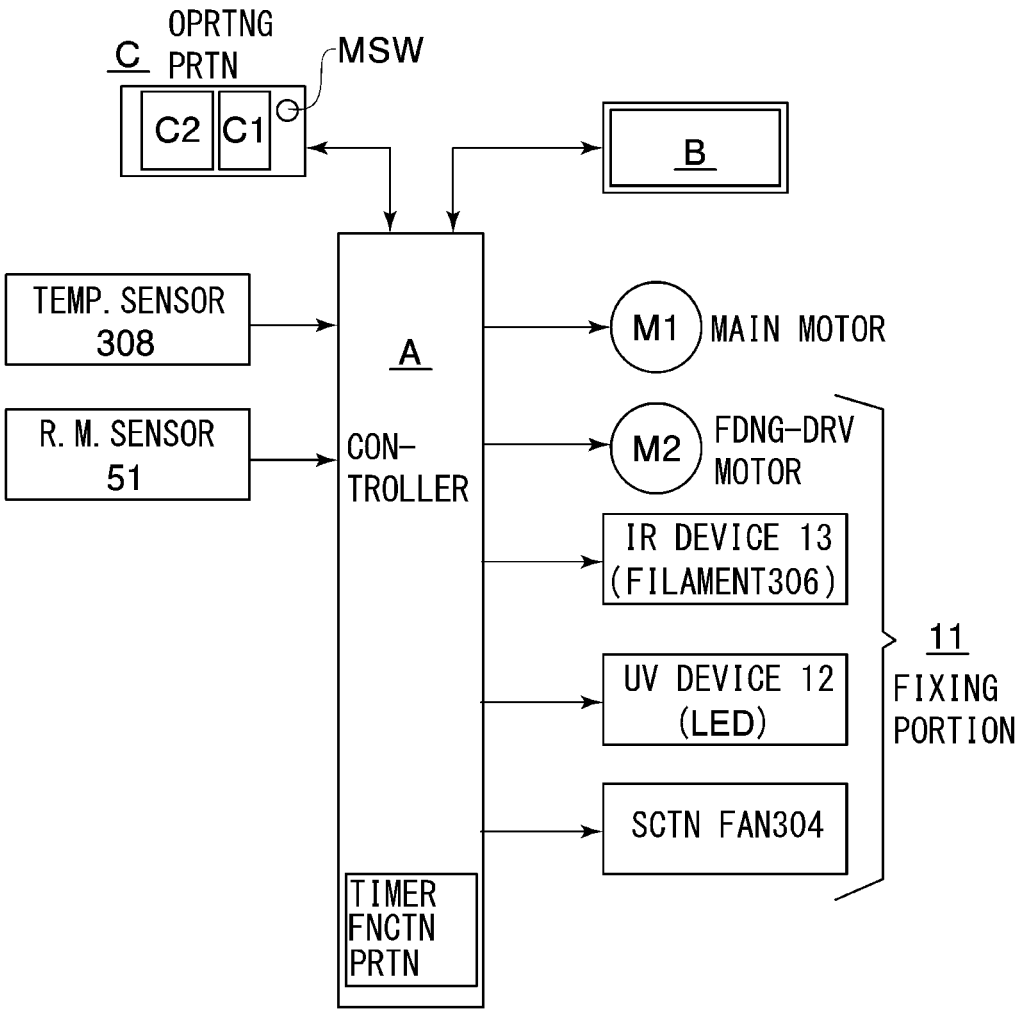
FIG. 4 is a block diagram of a control system.

The controller A controls all the devices of the apparatus 100 and a sequence of an image forming operation. C represents an operating portion (user interface) of the image forming apparatus 100. The operating portion C includes, as shown in FIG. 4, a main power (source) switch MSW, ten keys and various buttons C1 for inputting various pieces of information, and a display portion C2 such as a liquid crystal (type) touch panel, and the like. On the display portion C, various pieces of information are displayed by the controller A and the host device B. Various pieces of information can also be inputted from the display portion C to the controller A.

This apparatus 100 includes an image forming portion 10 for forming an unfixed image on the recording material with a liquid developer containing toner and a liquid carrier (ultraviolet curable liquid, ultraviolet curable agent) which is cured by the UV light (ultraviolet curable type). Further, the apparatus 100 includes a fixing portion (fixing device) 11 for fixing an image 15, formed on a recording material 16, on the recording material 16.

The recording material 16 is a sheet-like recording medium (media) on which an image is formed by the image forming apparatus 100, and may also be, for example, plain paper, coated paper, a postcard, an envelope, an OHP sheet or a resinous film. In the following, the recording material is also referred to as a sheet or paper. The sheets 16 are accommodated in a sheet (paper) feeding cassette 25 in a bundle state. The sheets 16 in the sheet feeding cassette 25 are separated into a single sheet by a sheet feeding mechanism 2, and is fed toward the image forming portion 10 via a feeding passage 26. The sheet feeding cassette 25 is provided in a plurality of stages, and those in which a material and a size of the sheets 16 are different can also be disposed in the image forming apparatus 100 in advance.

The image forming portion 10 includes a cylindrical photosensitive drum 1 as an image bearing member. Further, the image forming portion 10 includes electrophotographic image forming means (process devices) provided around the photosensitive drum 1. Specifically, the means are a charging portion 10*a* for electrically charging a surface of the photosensitive drum 1 uniformly, an exposure portion 10*b* for preparing an electrostatic latent image by light exposure, a developing portion 10*c* for developing the electrostatic latent image into an image by the above-described liquid developer, a transfer roller 4, a cleaner portion 10*d* for removing an unnecessary irradiating device.

The photosensitive drum 1 in this embodiment has an organic photosensitive layer at a surface thereof by an aluminum-made cylinder of 3 mm in thickness and 84 mm in outer diameter, and is 370 mm with respect to a longitudinal width (length with respect to a direction substantially perpendicular to a sheet feeding direction).

The transfer roller 4 is a roller constituted by two kinds of materials, in which a rubber made of methane is wound about a metal shaft which is a core metal of an SUM material subjected to KN plating. Further, the transfer roller 4 is disposed so as to form a nip (transfer nip) in contact with the photosensitive drum 1 by being pressed against the photosensitive drum 1 by a pressing mechanism (unshown).

The photosensitive drum 1 is rotationally driven about a center supporting shaft 1*a* in an arrow R1 direction in FIG. 2 at a predetermined peripheral speed (process speed) by a driving motor M1 (main motor: FIG. 4) which is a driving means controlled by the controller A. At this time, the transfer roller 4 is also rotationally driven in an arrow R2 direction which is the same direction as a rotational direction of the photosensitive drum 1 in a nip by the driving motor M1.

The sheet 16 sent from the sheet feeding cassette 25 is controlled so as to enter the nip formed from the photosensitive drum 1 and the transfer roller 4 so that the sheet 16 is synchronized with the toner image (image of the liquid developer) obtained (formed) through development of the electrostatic latent image on the photosensitive drum 1 by the above-described developing portion 10*c*. Further, in a process in which the sheet 16 is nipped and fed through the transfer nip, the toner image formed on the photosensitive drum 1 is successively transferred onto an arbitrary position on the sheet 16. That is, on the sheet 16 (on the recording material), an unfixed image 15 by the liquid developer is transferred and formed. The sheet 16 on which the image 15 is formed by the image forming portion 10 passes through a feeding passage 27 and is fed to a fixing portion 11.

51 is a jam detection sensor (recording material sensor) provided on the feeding passage 27. This sensor 51 is disposed on the feeding passage (recording material feeding passage) 27 on a side (on a side upstream in the recording material feeding direction) upstream of a sheet feeding device (recording material feeding mechanism) 30 in the fixing portion 11 described later.

When the sheet 16 is not present in a position of this sensor 51, the sensor 51 outputs an off signal, and when the sheet 16 is present in the position, the sensor 51 outputs an on signal, and the off signal and the on signal are inputted to the controller A. The controller A discriminates that a sheet jam occurred in the case where the on signal or the off signal inputted from the sensor 51 is longer or shorter than a predetermined time on the sequence after a start of feeding of the sheet 16 from the sheet feeding cassette 25.

That is, the controller A discriminates whether or not the sheet 16 is fed at proper timing by switching between the on signal and the off signal of the sensor 51 with the sheet feeding, and passes through the image forming portion 10. The controller A discriminates that the sheet 16 cannot be fed at proper timing in the case where the sensor 51 is not turned on even when a predetermined time elapsed or the on signal of the sensor 51 continues for a predetermined or more. In this case, the controller A discriminates that the jam occurred and causes the image forming apparatus 100 to emergently stop the image forming operation, and causes the operating portion C or the display portion of the host device B to display a message prompting a user to perform jam clearance.

Incidentally, in this embodiment, the image forming portion 10 had the constitution of the electrophotographic type-direct transfer type, but an image forming method on the sheet 16 is not limited thereto. For example, the image forming portion 10 may also have a constitution of an intermediary transfer type in which the photosensitive drum 1 is changed to an intermediary transfer belt. Specifically, an image formed on the photosensitive drum by the image forming means is primary-transferred onto the intermediary transfer member by a primary transfer roller, and the transfer means 4 is a secondary transfer roller by which the image on the intermediary transfer member is transferred onto the sheet 16.

The fixing portion 11 includes an IR irradiating device (infrared irradiating portion) 13 for irradiating the sheet 16 with the IR light, a UV irradiating device (ultraviolet irradiating portion) 12 for irradiating the sheet 16 with the UV light, and the sheet feeding device (recording material feeding mechanism) 30 for feeding the sheet 16.

The sheet 16 which is fed from the image forming portion 10 to the fixing portion 11 through the feeding passage 27 and on which the unfixed image 15 by the liquid developer is placed is substantially fed by the sheet feeding device 30 of the fixing portion 11. Then, in a process in which the sheet 16 passes through below the IR irradiating device 13, the sheet 16 is irradiated with the IR light and is heated, and a temperature of the sheet 16 itself is increased to a predetermined temperature, and immediately thereafter, in a process in which the sheet 16 passes through below the UV irradiating device 12, the sheet 16 is irradiated with the UV light. By this UV irradiation, the unfixed image 15 by the liquid developer on the sheet is fixed as a fixed image through UV curing.

Here, a mechanism relating to the liquid developer of the UV curable type used in this embodiment 1 and to curing thereof will be briefly described.

Figure 5:
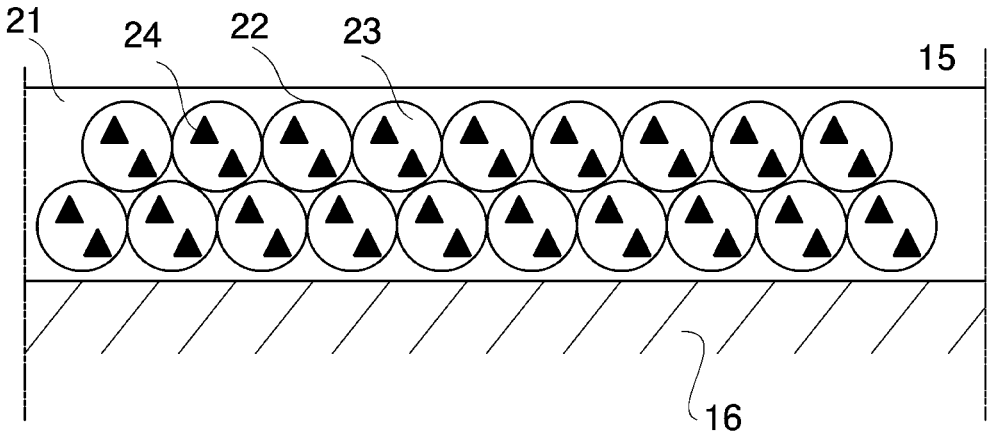
FIG. 5 is a schematic sectional view of an image by a liquid developer of a ultraviolet curable type.

FIG. 5 is a schematic sectional view of the unfixed image 15, by the liquid developer of the UV curable type, formed on the sheet 16. In this image 15, toner (toner particles) 22 is dispersed in a liquid carrier (ultraviolet curing agent) 21 curable by the UV light. The liquid carrier 21 is constituted by at least a photo-polymerization agent and a monomer for an ultraviolet curable agent. The toner 22 is constituted by a toner resin 23 which is a base material of the toner 22 and a coloring material 24.

For example, in the case of cationic polymerization, when the UV light falls on the liquid carrier 21, a photo-polymerization initiator excited by the UV light generates an acid, and the generated acid and the monomer start polymerization reaction, and the liquid carrier 21 starts curing. Accordingly, fixing of the unfixed image 15 by the liquid developer of the UV curable type is carried out by curing the liquid carrier 21 on the sheet 16 through the UV light irradiation and by fixing the liquid carrier 21 and the toner 22 on the sheet 16.

The sheet 16 subjected to a fixing process by the fixing portion 11 passes through a discharge feeding passage 28 and is discharged as an image-formed product (product) to an outside of a discharging unit (unshown) or is introduced into a finisher portion (unshown). The finisher portion is a post-processing unit for subjecting the fixing-processed sheet 16 to various finisher processes, for example, stapling, punching, book-binding processing, and the like.

(Detailed Structure of Fixing Portion)

Figure 3:
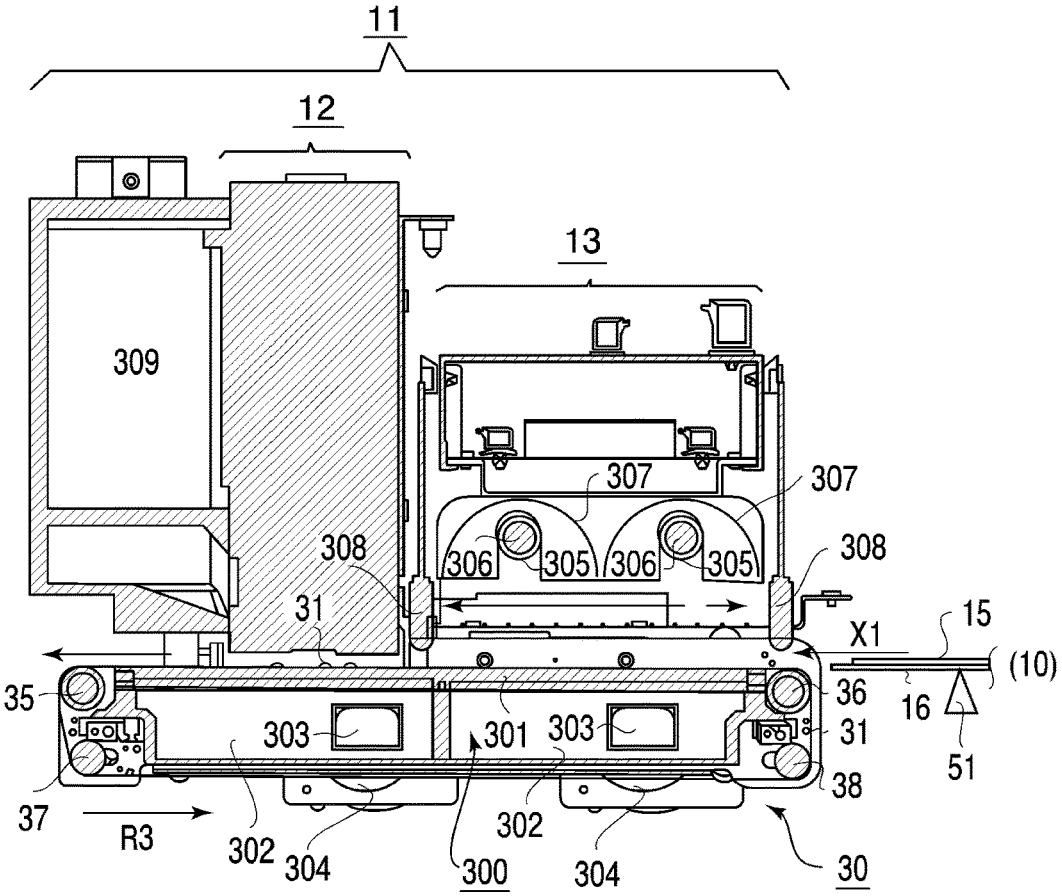
FIG. 3 is a schematic enlarged view of a portion of the fixing portion (fixing device) of the image forming apparatus.

FIG. 3 is a schematic enlarged view of a portion of the fixing portion (fixing device) 11 in the image forming apparatus 100 of FIG. 2. The fixing portion 11 is roughly divided into three units of the IR irradiating device 13, the UV irradiating device 12, and the sheet feeding device (recording material feeding mechanism) 30.

(1) Sheet Feeding Device

Referring to FIG. 3, the sheet 16 on which the unfixed image 15 by the liquid developer is formed at an upper surface thereof and which is fed from the image forming portion 10 enters the fixing portion 11 from an arrow X1 (direction). The sheet feeding device 30 is a unit for feeding the sheet 16 entered the fixing portion 11 in an arrow Y1 direction and for delivering the sheet 16 to the discharging unit (unshown) or the finisher portion (unshown) which are described above.

The sheet feeding device 30 includes an endless belt (endless rotatable belt with air permeability, perforated belt: hereinafter referred to as a belt) 31 perforated with numbers of holes. Further, the sheet feeding device 30 includes a driving roller 35 and follower rollers 36, 37 and 38 as belt stretching members (belt supporting members) for stretching this belt 31 so as to be rotatable. Further, the sheet feeding device 30 includes a feeding driving motor M2 (FIG. 4) for rotating the belt 31 through the driving roller 35.

The belt 31 is rotated in an arrow R3 direction at a predetermined peripheral speed (process speed) by drive of the feeding driving motor M2. The belt 31 in this embodiment 1 is 350 mm in width and 900 mm in peripheral length, and employs a PI resin as a material thereof. The belt 31 rotates at a peripheral speed of 785 mm/s.

Inside the belt 31, an air sucking portion (arrow sucking system) 300 for sucking and holding the sheet 16 on the belt. The air sucking portion 300 includes a perforated plate (perforated board) as a flat plate-like belt supporting plate (attraction plate) 301 which supports an inner surface of an upper-side belt portion (belt portion on the recording material feeding side) of the belt 31 at an upper surface thereof and which has air permeability. Further, the air sucking portion 300 includes a suction chamber 302 consisting of a heat-resistant resin (PPS resin in this embodiment) fixedly provided so as to closely contact the plate 301 on a lower surface side of this plate 301.

The suction chamber 302 includes two chambers, and to each of the chambers 302, a duct 303 through which the air passes is connected, and to an end of the duct 303, a fan 304 for sucking the air, controlled by the controller A is mounted. The inner surface of the belt portion of the belt 31 on the upper side of the belt 31 is supported by the upper surface of the plate 301 so as to be slidable. When the belt 31 is rotationally driven, the belt inner surface slides and moves (sliding) on the upper surface of the plate 301 while contacting the upper surface of the plate 301.

The air sucking portion 300 imparts, through the perforated plate 301 and the perforated belt 31, a negative pressure for sucking and holding the sheet 16 on the belt 31. That is, the suction fan 304 operates (turned on), whereby the air is sucked by an entire surface of the perforated belt 31 on the upper surface side and always forms an air flow in a rear side direction on the drawing surface of FIG. 3 through the suction chamber 302, so that the air flow of the sheet feeding device 30 is formed.

Then, when the sheet 16 on which the unfixed image 15 is placed comes onto the belt 31 from the image forming portion 10 side, the sheet 16 is fed in an arrow Y1 direction by the belt 31 rotating while sucking the sheet 16 on the belt 31 at the upper surface of the belt 31, on a side (back surface) where the unfixed image 15 is not present.

In a feeding process thereof, the sheet 16 on which the unfixed image 15 was formed by the image forming portion 10 successively passes through below the IR irradiating device 13 and the UV irradiating device 12 which are disposed opposed to the upper-side belt portion of the belt 31. By this, heating (pre-heating: image heating) of the sheet 16 by the irradiation with the IR light and image infrared by the irradiation with the UV light are carried out. That is, the fixing is carried out in non-contact with the surface of the unfixed image 15 without forming a fixing nip. That is, the above-described sheet feeding device 30 feeds the sheet 16 with no contact objects, such as a fixing roller and a fixing belt, to the unfixed image 15.

According to the above-described sheet feeding device 30, the sheet 16 on which the unfixed image 15 is placed follows the flat plate-like perforated plate 301 supporting the belt 31 and is fed in a substantially flat surface state. Then, in this flat surface state, the sheet 16 is subjected to heating and UV curing fixing of the unfixed image 15 by the IR irradiating device 13 and the UV irradiating device 12, so that the fixing is completed in a state in which deformation such as a curl of the sheet 16 is suppressed. That is, the flat plate-like perforated plate 301 suppresses the deformation such as the curl of the sheet 16 due to the fixing operation.

As described above, in the sheet feeding device 30, the flat plate-like perforated plate 301 supporting the belt inner surface exists inside the belt portion feeding the sheet 16 while sucking the air. For that reason, when the unfixed image 15 is fixed on the sheet, the sheet follows the belt 31, i.e., the flat plate-like (perforated) plate 301 and is held in a straight state (flat state), so that the fixing is completed. Accordingly, the deformation of the curl or the like of the sheet 16 during the image fixing of the sheet 16 is prevented, so that an effect of reliably delivering the sheet 16 to a roller pair on a side downstream of the sheet feeding device 30 is achieved.

In this embodiment, the sheet feeding device 30 carries the sheet 16, on which the image 15 was formed by the image forming portion 10, on the belt 31 by the air suction, and feeds the sheet 16 so that the sheet 16 successively passes through below the IR irradiating device 13 and the UV irradiating device 12. That is, the IR irradiating device 13 and the UV irradiating device 12 are juxtaposed immediately above the upper-side belt portion of the belt 31 so as to oppose the belt and to be adjacent to each other on the upstream side and the downstream side of the sheet feeding direction.

By this, the image 15 of the liquid developer on the sheet 16 fed while being carried on the belt 31 is first heated by being subjected to the irradiation with the IR light by the IR irradiating device 13 and then is fixed by being subjected to the irradiation with the UV light by the UV irradiating device 12.

The sheet feeding device 30 feeds the sheet through suction feeding, so that the sheet is not nipped by the feeding rollers and the like at an IR irradiation position and at a UV irradiation position. That is, the fixing device in this embodiment is a fixing device in which the sheet is not pressed at the IR irradiation position and at the UV irradiation position.

Here, the UV irradiation position refers to a position where maximum illuminance (peak illuminance) by the UV irradiating device 12 is provided as seen in a positional distribution with respect to the sheet feeding direction. Further, the IR irradiation position refers to a position of a center of a region where illuminance which is 90% or more of peak illuminance of the IR irradiating device 13 as seen in a positional distribution with respect to the sheet feeding direction.

(Structure of IR Irradiating Device)

As regards the IR irradiating device 13, a light source irradiates electromagnetic wave (radiation) of far-infrared radiation with a wavelength of 1-15 μm. A chemical bond in an organic material has an absorption characteristic in a far-image forming region, and therefore, the organic material such as the toner-containing liquid developer used in this embodiment is capable of being efficiently heated by being irradiated with the far-infrared radiation.

In this embodiment, as an object irradiating the far-infrared radiation (infrared radiation member), a quartz tube 305 of 17 mm in diameter and 450 mm in length is employed. A center position of the quartz tube 305 is disposed at a position of a height of 80 mm from the belt 31. Then, the sheet 16 on which the unfixed image 15 is placed is increased in temperature in a non-contact manner.

In the quartz tube 305, a filament 306 consisting of a nichrome wire is provided. By performing energization to the filament 306, the filament 306 is heated and irradiates the far-infrared radiation through the quartz tube 305. The sheet 16 is efficiently irradiated with the far-infrared radiation irradiated from the quartz tube 305, and therefore, a reflector 307 made of aluminum is provided so as to cover the quartz tube 305.

Further, two sets each of a combination of the quartz tube 305 and the reflector 307 are disposed, and a length L of the reflectors 307 of the two sets in total is 175 mm, and output is 2600 W in total of the two sets. The sheet 16 passes at 785 mm/s, and therefore, an IR irradiation time is 0.22 sec. On both sides of the IR irradiating device 13, temperature sensors (non-contact thermometers) 308 are provided and measure a temperature of the belt 31.

(Structure of UV Irradiating Device)

On a side immediately downstream of the IR irradiating device 13 (on the downstream side of the recording material feeding direction), the UV irradiating device 12 is disposed. The UV irradiating device 12 uses an LED irradiating the UV light (LED: Light Emitting Diode). This is an important item in UV curing reaction and means that "an optical science change only occurs by absorbed light of projected light quantity". That is, in UV curing, it is important that absorption wavelength of the photopolymerization initiator and emission wavelength of the UV light coincide with each other.

In this embodiment, an LED of 385±5 μm in illuminance peak wavelength and 1.8 W in illuminance peak is used. In the UV develop 12, a cooling duct 309 for preventing temperature rise of the UV irradiating device 12 itself and an air blowing fan (unshown) are mounted.

(Effect of Heating by IR Irradiating Device)

Next, in a UV curing process of the liquid developer, an effect of heating by irradiating the unfixed image 15 with the IR light before the UV irradiation will be described.

Figure 6:
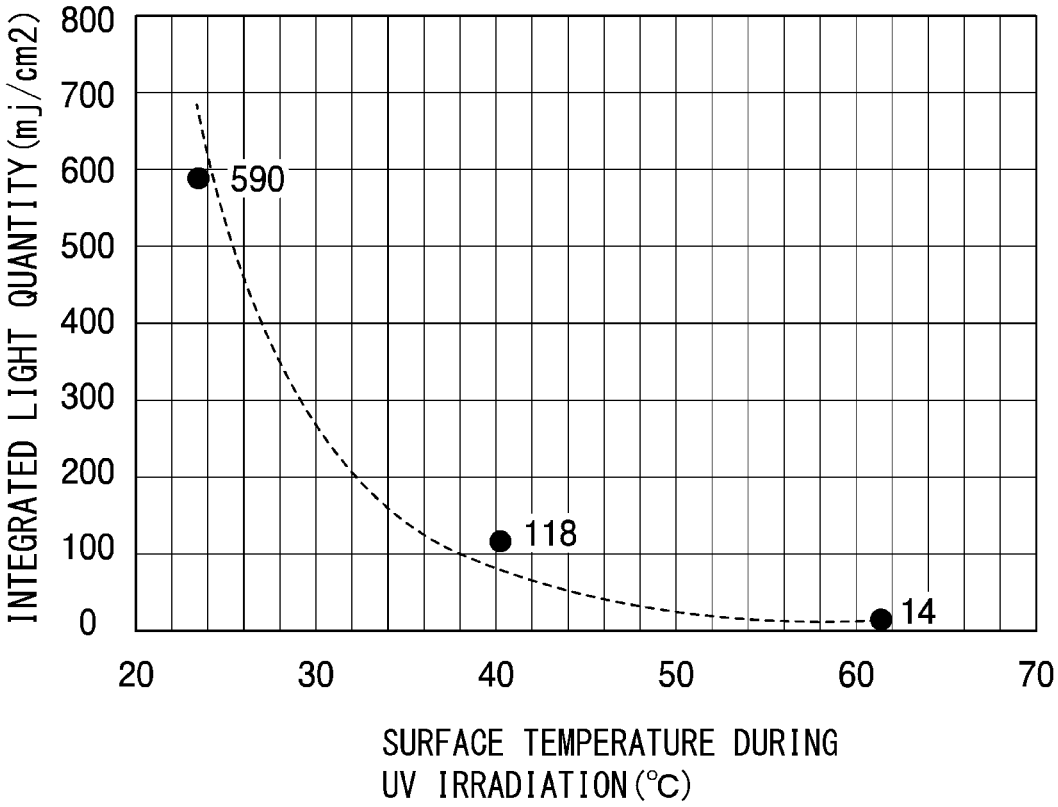
FIG. 6 is a correlation graph of an integrated light quantity relative to a developer temperature.

FIG. 6 shows a relationship of an integrated light quantity ($mJ/cm^2$) of the UV light necessary to cure the liquid developer, to a surface temperature of the liquid developer in the unfixed image. As is understood from FIG. 6, with rise of the temperature of the liquid developer, the integrated light quantity ($mJ/cm^2$) of the UV light necessary to cure the liquid developer becomes small. For example, in the case where the surface temperature of the liquid developer is 23° C., the integrated light quantity of the UV light is 590 $mJ/cm^2$. On the other hand, in the case where the surface temperature of the liquid developer is 40° C., the integrated light quantity is 118 $mJ/cm^2$. When the liquid developer temperature is compared between 40° C. and 23° C., there is a difference of 5 times electric power consumption of the UV irradiating device 12.

Here, 23° C. is assumed as an environment in which the image forming apparatus 100 is installed and as a temperature of the sheet 16. Further, a thickness of the unfixed image formed on the sheet 16 is merely a thickness of several jam, and a temperature thereof would be considered as being substantially identical to the temperature of the sheet 16.

In a study of the electric power consumption of the UV irradiating device 12 by the present inventors, it turned out that the electric power consumption is 2800 W in the case where the temperature of the sheet 16 is 40° C. Assuming that the temperature of the sheet 16 is 23° C., the electric power consumption of the UV irradiating device 12 is 5 times the electric power consumption at 40° C., so that 2800 W×5=14000 W is needed.

Further, in a study of temperature rise of the sheet 16 by the present inventors, it turned out that electric power consumption for increasing the temperature of the sheet 16 from 23° C. to 40° C. is 2600 W.

From results of the above-described studies, electric power consumption when the IR irradiating device 12 and the UV irradiating device 13 are combined for curing the liquid developer is 2600 W+2800 W=5400 W.

On the other hand, electric power consumption in the case where the curing of the liquid developer is carried out only by the UV irradiating device 12 at the temperature of 23° C. of the sheet 16 is 14000 W.

From these results, it is understood that the case where the curing of the liquid developer is carried out by combining the IR irradiating device 13 with the UV irradiating device 12 is overwhelmingly advantageous as the electric power consumption.

(Operation Sequence of Fixing Portion)

Next, an operation sequence of the fixing portion 11 will be described. When a main power (source) switch MSW (FIG. 4) of the image forming apparatus 100 is turned on (power: on), the controller A starts a stand-by operation for adjusting each of the image forming portion 10 and the fixing portion 11 to a capable state (state in which an image forming operation is enabled). The stand-by operation is also called an adjusting operation, a rising operation or a warm-up operation.

FIG. 1 shows a flowchart (stand-by operation sequence) about the stand-by operation of the fixing portion 11 in this embodiment 1. As regards the stand-by operation of the image forming portion 10, description will be omitted for convenience.

(1) When the power (source) is turned on (S1: power-on of the image forming apparatus), the controller A causes the feeding driving motor M2 for the sheet feeding device 30 in the fixing portion 11 to drive, so that rotation of the belt 31 is started through the driving roller 35 (S2). Here, the controller A checks the rotation of the belt 31 by a rotation detection sensor (unshown). If the rotation detection sensor cannot detect the rotation of the belt 31, the controller A discriminates that the apparatus is abnormal, and causes the display portion C2 of the operating portion C to display an error and at the same time causes the apparatus 100 to stop an operation thereof (S8).

Further, if the belt 31 is irradiated in a rest state thereof with the UV light from the UV irradiating device 12, only the belt portion immediately below the UV irradiating device 12 is subjected to the UV irradiation, so that there is a possibility that the belt 31 is damaged. For that reason, there is a need that the UV irradiation is started always after the belt 31 is rotated.

(3) When the controller A can check that there is no abnormality in UV irradiation of the UV irradiating device 12, the controller A starts energization to the filament 306 in the IR irradiating device 13, so that the temperature (surface temperature 9 of the quartz tube (infrared radiation member) 305 is increased and the irradiation with the IR light is started (S4). Here, the controller A checks an IR irradiation state of the IR irradiating device 13 by a state detecting sensor (unshown). In the case where the IR irradiation is not carried out or there was abnormality in IR irradiation light quantity by the checking with this state detecting sensor, the controller A discriminates that the apparatus is abnormal, and causes the display portion C2 of the operating portion C and at the same time causes the apparatus 100 to stop the operation thereof (S10).

Further, if the quartz tube 305 is heated in a state in which the belt 31 is at rest, only the belt portion immediately below the IR irradiating device 13 is subjected to the irradiation with the IR light, so that there is a possibility that the belt 31 is damaged. For that reason, there is a need that energization to the IR irradiating device 13 is started always after the belt 31 is rotated.

(4) In the case of this embodiment, in order to increase the temperature of the sheet 16 from 23° C. to 40° C., there is a need that a temperature of the quartz tube 305 which is the infrared radiation member reaches a predetermined temperature, specifically about 830° C. at a surface of the quartz tube 305. However, it is difficult to detect the temperature directly by the sensor.

Therefore, in this embodiment, the controller A detects, by the temperature sensors 308, whether or not the surface temperature of the belt 31 reached a predetermined heating temperature (stand-by completion temperature) within a predetermined time from a start of energization to the IR irradiating device 13 (a start of energization to the filament 306). In this embodiment, the predetermined heating temperature of the belt 31 is 50° C.

The controller A discriminates that the surface (temperature) of the quartz tube 305 reached about 830° C. described above by that the temperature sensor 308 detects the belt temperature of 50° C. (S5). Further, the controller A discriminates that the apparatus is abnormal in the case where the temperature sensor 308 does not detect the belt temperature of 50° C. within the predetermined time, and causes the display portion C2 of the operating portion C and at the same time causes the apparatus 100 to stop the operation thereof (S11).

(5) in the step S5, when the temperature sensor 308 detects the belt temperature of 50° C., the controller A causes the suction fan 304 of the air sucking system 300 for attracting the sheet 16 to the belt 31 of the sheet feeding device 30 to be turned on (S6). Here, the controller A checks the rotation of the suction fan 304 by a rotation detection sensor (unshown). If the rotation detection sensor cannot detect the rotation of the suction fan 304, the controller A discriminates that the apparatus is abnormal, and causes the display portion C2 of the operating portion C to display an error and at the same time causes the apparatus 100 to stop an operation thereof (S12).

(6) If the controller A can check the rotation of the suction fan 304, the controller A discriminates that the stand-by operation of the entire image forming apparatus was completed, in combination with checking of completion of the stand-by operation of the image forming portion 10. Further, the controller A causes the display portion C2 of the operating portion C to display copy operation OK and at the same time enables reception of a job (S7).

Thereafter, the controller A controls electric power supplied to the IR irradiating device 13 so that the surface temperature of 50° C. of the belt 31 is maintained, on the basis of surface temperature detection information of the belt 31 inputted from the temperature sensor 308.

A feature of the above-described operation flow is that in the stand-by operation after the power of the apparatus 100 is turned on, an air sucking operation of the air sucking portion 300 is started (suction fan 304: on) after the temperature of the quartz tube 305 of the IR irradiating device 13 in the fixing portion 11 reached a predetermined temperature.

In this embodiment, the temperature sensor 308 for detecting the surface temperature of the belt 31 is provided, and whether or not the surface temperature of the belt 31 reached the predetermined heating temperature (50° C. in this embodiment) within the predetermined time from the start of the energization to the IR irradiating device 13 is monitored by the temperature sensor 308. Then, detection that the surface temperature of the belt 31 reached the predetermined heating temperature is made by the temperature sensor 308, whereby the controller A is caused to discriminate that the temperature of the quartz tube 305 of the IR irradiating device 13 reached the predetermined temperature.

Figure 7:
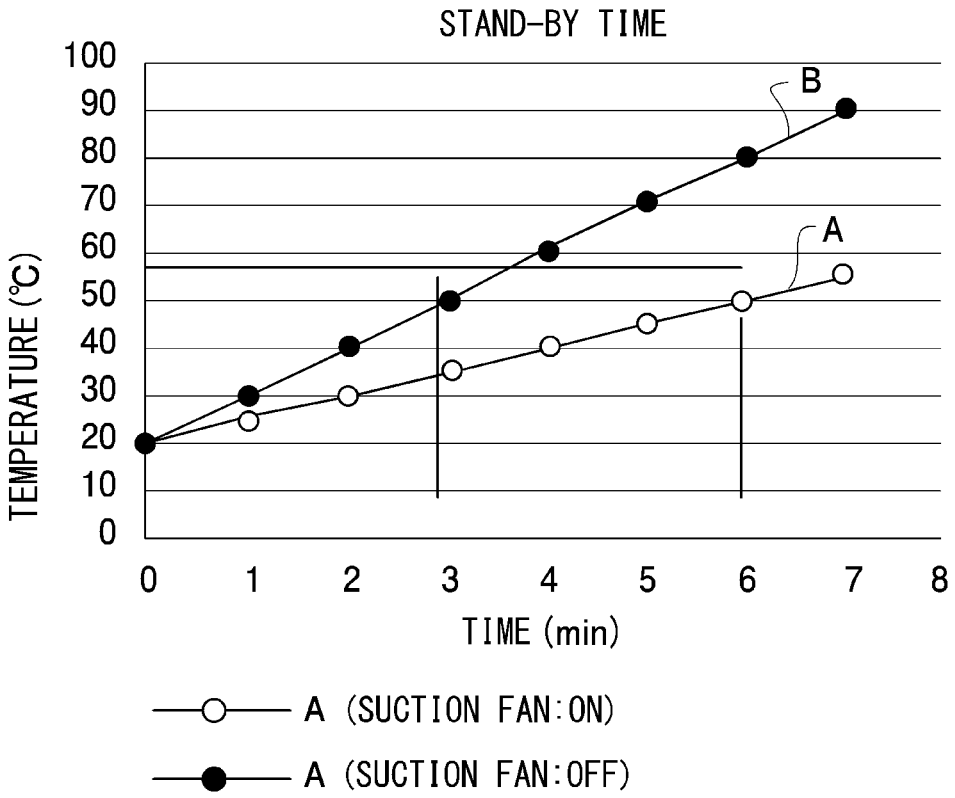
FIG. 7 is a feeding belt temperature progression graph at presence (on) and absence (off) of a suction fan.

The reason why as described above, the suction fan 304 is turned on after the temperature of the quartz tube 305 of the IR irradiating device 13 becomes the predetermined temperature (in this embodiment, the surface temperature of the belt 31 becomes 50° C.) during the stand-by operation will be described using FIG. 7. In the graph of FIG. 7, the ordinate represents the surface temperature (° C.) of the belt 31, and the abscissa represents an elapsed time (min).

From a state of a room temperature of 20° C., the case where a sucking operation of the suction fan 304 is performed (suction fan: on) is A, and the case where the sucking operation of the suction fan 304 is not performed (suction fan: off) is B. Then, times until the belt 31 (temperature) becomes a stand-by completion temperature of 50° C. in the respective cases are compared. In this embodiment, in the case B where the sucking operation is not performed, the belt 31 reaches 50° C. in about 3 minutes. On the other hand in the case A where the sucking operation is performed, there is a need to take a time of about 6 minutes until the belt 31 reaches 50° C.

That is, it is understood that a large difference in time until the stand-by operation is completed arise between the case B where the sucking operation is not performed and the case A where the sucking operation is performed. Naturally, it is understood that the non-performance of the sucking operation of the suction fan 304 is useful for shortening a stand-by operation time (warm-up time) and for improving operativity of a user.

As described above, in the stand-by operation after the power of the apparatus 100 is turned on, the air sucking portion 300 (suction fan 304) is not operated until the infrared radiation member 305 of the IR irradiating device 13 reaches the predetermined temperature, so that there is no air flow action unnecessary for the IR irradiating device 13. For that reason, an effect that a temperature rising time for heating the sheet by the IR irradiating device 13 is shortened is achieved.

Here, as regards control of the air sucking portion 300, the controller A causes the IR irradiating device 13 to be turned on in accordance with the power-on of the apparatus 100, and causes the air sucking portion 300 to start the air sucking operation after the temperature of the infrared radiation member 305 of the IR irradiating device 13 reached the predetermined temperature.

The start of the IR irradiation of the IR irradiating device 13 is carried out from the time of the stand-by, but there is no need that the start of the air sucking operation of the air sucking portion 300 is during the stand-by. That is, a constitution in which the suction is started after a print instruction is inputted may also be employed. There is substantially no time lag from the start of the suction until the pressure in the belt feeding mechanism becomes negative pressure, and therefore, even when the suction is started after the print instruction is inputted, the sucking operation is in time.

Embodiment 2

Figure 8:
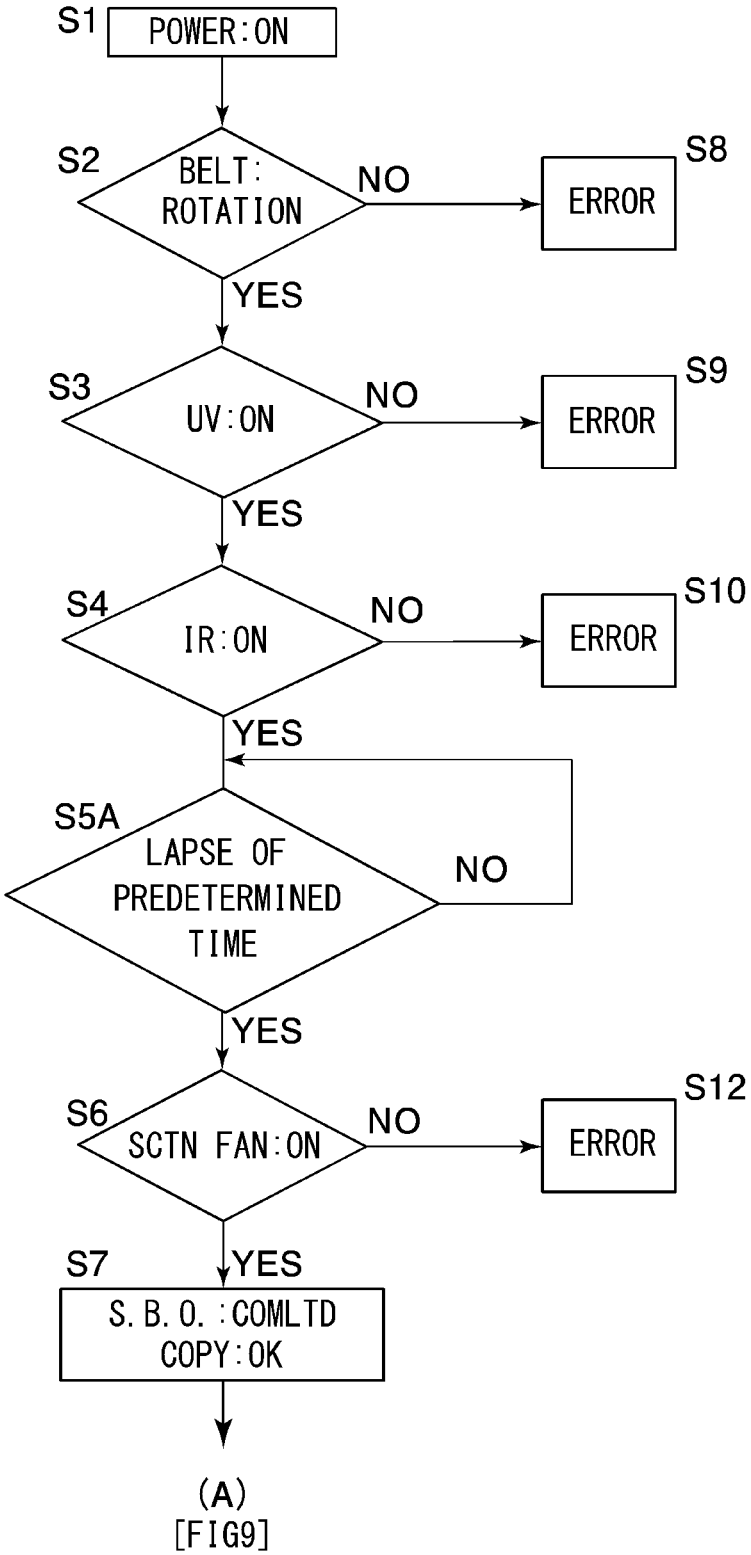
FIG. 8 is a flowchart of a stand-by operation of a fixing portion in an embodiment 2.

FIG. 8 shows a flowchart of a stand-by operation of a fixing portion 11 in this embodiment 2. In this embodiment 2, in comparison with the flowchart of FIG. 1 of the embodiment 1, the step S5 of detecting the belt temperature in the flowchart of FIG. 1 is changed to the following step S5A. The steps other than this step S5A are the same as those of the flowchart of FIG. 1.

The step S5A in this embodiment 2 is a step of discriminating whether or not a predetermined time elapsed from the turning-on of the infrared irradiation of the step S4, i.e., from the start of the energization to the IR irradiating device 13. The predetermined time in this embodiment is a time enough that the temperature of the quartz tube 305 which is the infrared radiation member reached the predetermined temperature (in this embodiment, about 830° C. at the surface thereof) with no error from the start of the energization to the IR irradiating device 13, and is a time acquired by actual measurement in advance.

In this embodiment, the controller A discriminates that the temperature of the quartz tube 305 of the IR irradiating device 13 reached the predetermined temperature by a lapse of the above-described predetermined time in the step S5A with no measurement of the temperature of the belt 31. Then, the suction fan 304 of the air sucking portion 300 for attracting the sheet 16 to the belt 31 of the sheet feeding device 30 is turned on (S6). Here, the controller A checks the rotation of the suction fan 304 by a rotation detection sensor (unshown). If the rotation detection sensor cannot detect the rotation of the suction fan 304, the controller A discriminates that the apparatus is abnormal, and causes the display portion C2 of the operating portion C to display an error and at the same time causes the apparatus 100 to stop an operation thereof (S12).

In this embodiment 2, the reason why the suction fan 304 is turned on after the temperature of the quartz tube 305 of the IR irradiating device 13 becomes the predetermined temperature during the stand-by operation is the same as the reason in the stand-by operation of FIG. 1 in the embodiment 1. Further, similarly as in the embodiment 1, the start of the IR irradiation of the IR irradiating device 13 is carried out from the time of the stand-by, but there is no need that the start of the air sucking operation of the air sucking portion 300 is during the stand-by. That is, a constitution in which the suction is started after a print instruction is inputted may also be employed.

Embodiment 3

Figure 9:
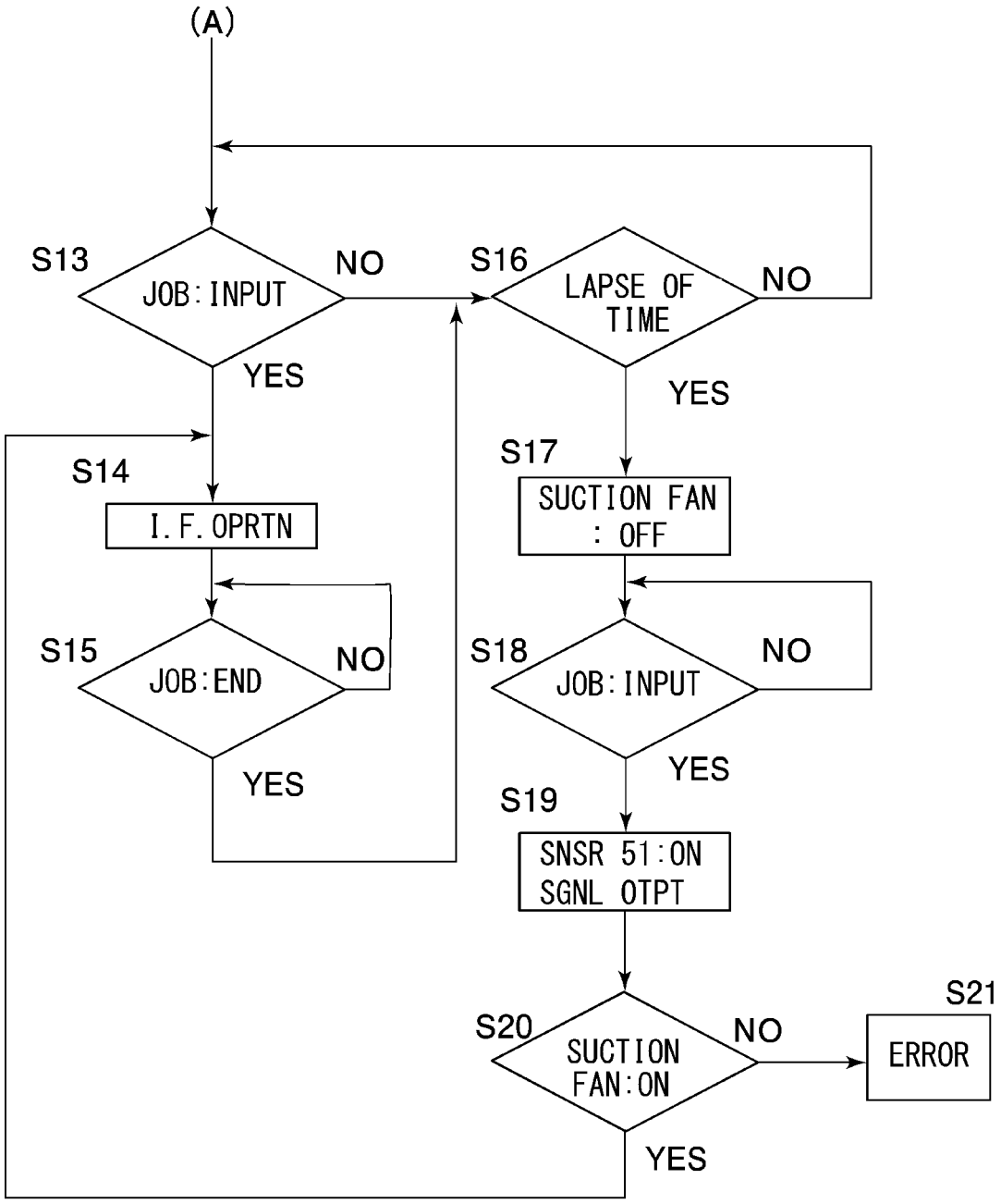
FIG. 9 is a flowchart of suction fan control in an embodiment 3.

FIG. 9 shows a control sequence of the suction fan 304 of the fixing portion 11 in the step S7 and later in FIG. 1 of the embodiment 1 and in FIG. 8 of the embodiment 2.

(1) The controller A waits for input of an image forming job for a predetermined time after completion of the stand-by of the step S7 (S13, S16).

(2) In the case where the image forming job is inputted in the predetermined time, the controller A executes the image forming operation of the inputted job until the job is ended (S14, S15).

(3) In waiting of the input of the image forming job in the step S13 or after a lapse of the predetermined time from the end of the job in the step S15, the controller A causes the air sucking portion 300 in the fixing portion 11 to stop the air sucking operation (suction fan 304: off) (S17). Then, in this state, the controller A waits for input of an image forming job (S18).

(4) When the image forming job is inputted in this state, the controller A causes the air sucking portion 300 to start the air sucking operation (S20) on the basis of a recording material detection signal of a first sheet 16 in the inputted image forming job by the recording material sensor 51 (S19: on-signal output). That is, the suction fan 304 is turned on.

Here, the controller A checks the rotation of the suction fan 304 by a rotation detection sensor (unshown). If the rotation detection sensor cannot detect the rotation of the suction fan 304, the controller A discriminates that the apparatus is abnormal, and causes the display portion C2 of the operating portion C to display an error and at the same time causes the apparatus 100 to stop an operation thereof (S21).

The controller A executes an image forming operation of the image forming job inputted in a state in which the suction fan 304 is turned on in the step S20 (S14).

A feature of an operation flow of FIG. 9 is that the controller A causes the air sucking portion 300 to start the air sucking operation on the basis of the detection signal, by the sensor 51, of the first sheet of the job inputted in the state in which the air sucking operation of the air sucking portion 300 is at rest (S17 to S20). That is, a constitution in which a switching trigger from off to on of the suction fan 304 is realized by turning-on of the sensor 51 by the sheet 16 is employed.

In a period in which the waiting of the input of the job (S16 to S18), the air sucking operation of the air sucking portion 300 is at rest. For that reason, driving electric power for the suction fan 304 in the period, and electric power for temperature control of the belt 31 by the IR irradiating device 13 are reduced since there is no air flow action unnecessary for the IR irradiating device 13.

Embodiment 4

Figure 10:
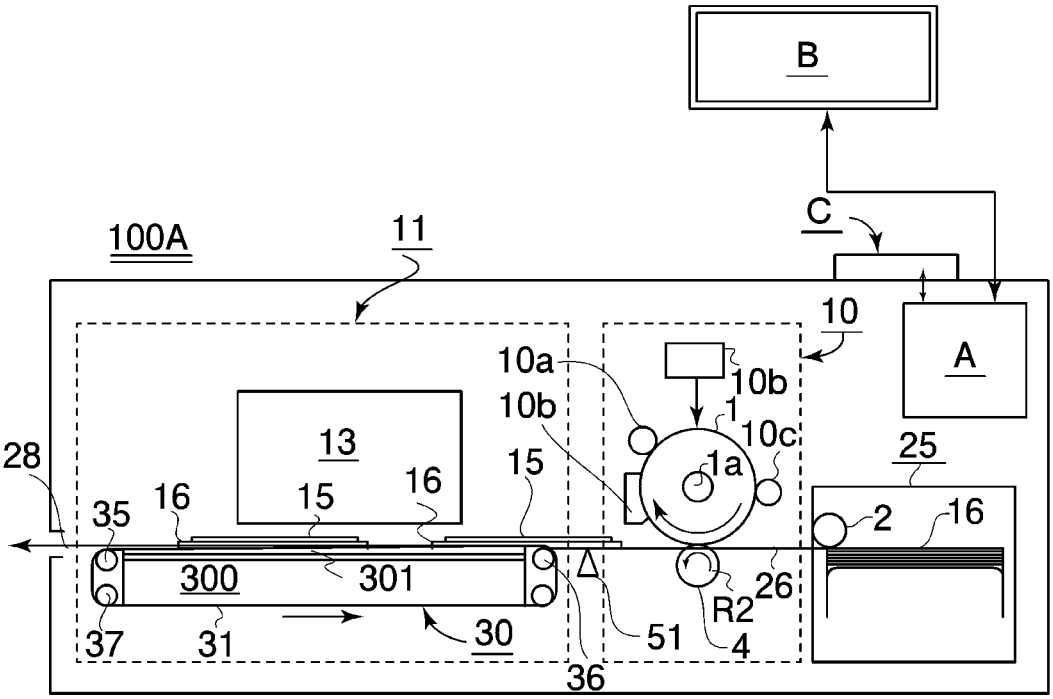
FIG. 10 is a schematic longitudinal front view of an image forming apparatus in an embodiment 4.

The image forming apparatuses 100 of the embodiments 1 to 3 are image forming apparatuses in which the UV curing fixing is carried out with the liquid developer, and for that purpose, the IR irradiating device 13 and the UV irradiating device 12 are disposed in the fixing portion 11. In the case of the image forming apparatus in which heating fixing is carried out with the developer fixed only by heating, as in an image forming apparatus 100A of FIG. 10, in a fixing portion 11, the UV irradiating device 12 is not disposed, but only the IR irradiating device 13 is provided.

Figure 11:
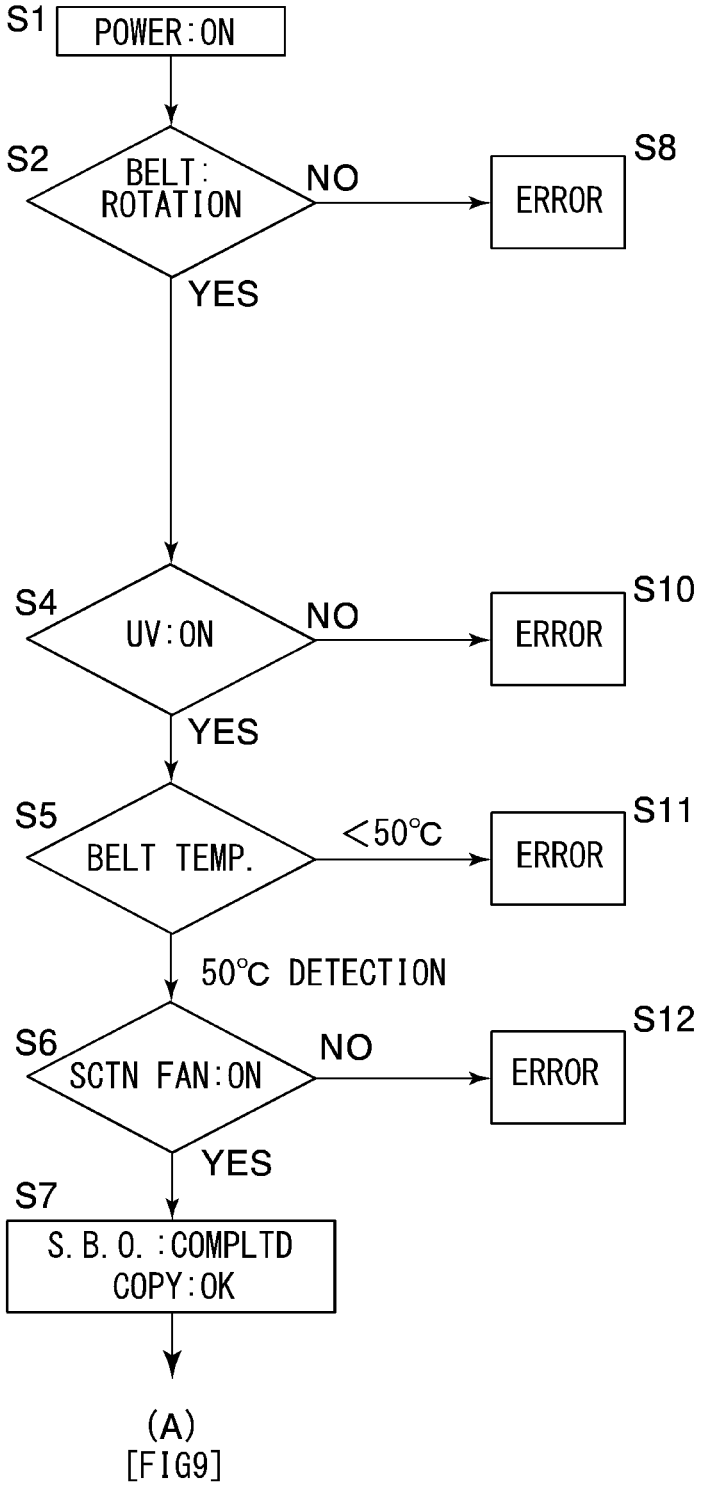
FIG. 11 is a flowchart of a stand-by operation of a fixing portion in the embodiment 4 (part 1).
Figure 12:
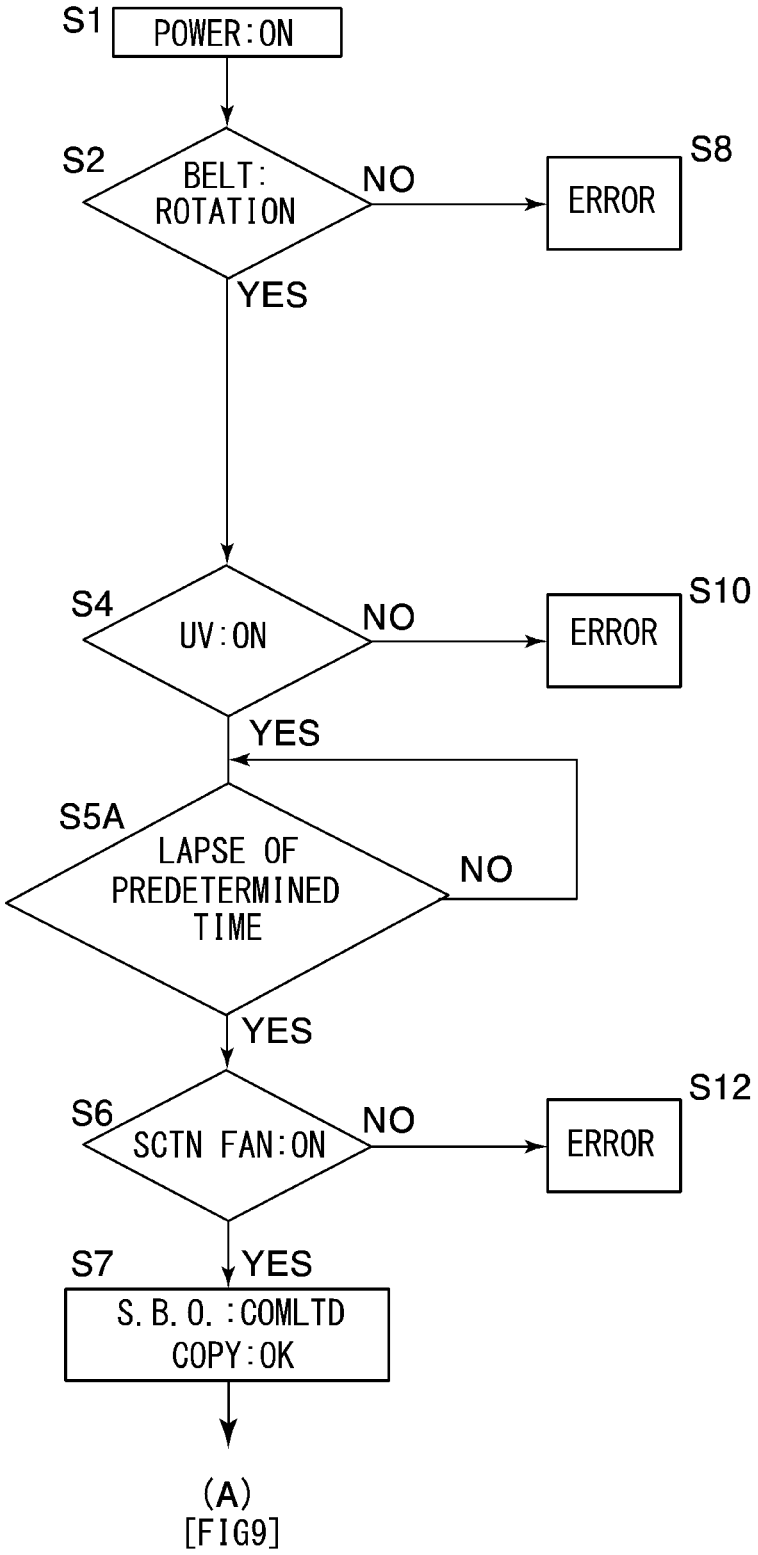
FIG. 12 is a flowchart of the stand-by operation of the fixing portion in the embodiment 4 (part 2).

FIG. 11 and FIG. 12 are flowcharts of stand-by operations of the fixing portion 11 in the case where the UV irradiating device 12 is not provided but only the IR irradiating device 13 is provided. FIG. 11 corresponds to the flowchart of FIG. 1 of the embodiment 1, and FIG. 12 corresponds to the flowchart of FIG. 8 of the embodiment 2, from which the steps S3 and S9 relating to the control of the UV irradiating device 12 are omitted. Further, in FIG. 11 and FIG. 12, the control sequence of the suction fan 304 of the fixing portion 11 in the step S7 and later is the same as the control sequence in FIG. 9 of the embodiment 3.

INDUSTRIAL APPLICABILITY

According to the present invention, there is provided an image forming apparatus in which a stand-by time is shortened.

The present invention is not limited to the above-described embodiments, but can be variously changed and modified without departing from the spirit and the scope of the present invention. Accordingly, the following claims are attached for making the scope of the present invention public.

The invention claimed is:

1. An image forming apparatus comprising:

an image forming portion for forming an unfixed image on a recording material;

a recording material feeding mechanism including (i) a rotatable endless belt perforated with numbers of holes and (ii) an air suction portion provided inside said belt, said air suction portion imparting negative pressure, through said belt, for sucking and holding the recording material on said belt, wherein said recording material feeding mechanism feeds the recording material on which the unfixed image is formed by said image forming portion, while sucking and holding the recording material on said belt on a recording material feeding side of said belt;

an infrared irradiating portion opposed to said belt on the recording material feeding side, said infrared irradiating portion having an infrared radiation member for heating the image by irradiating the recording material fed while being sucked and held on said belt with infrared radiation;

a temperature sensor for detecting a surface temperature of said belt; and a controller for controlling operations of said recording material feeding mechanism and said infrared irradiating portion, wherein said controller turns on said infrared irradiating portion in accordance with power on of said image forming apparatus and causes said air suction portion to start an air sucking operation after a detection of said temperature sensor has reached a predetermined heating temperature.

2. An image forming apparatus comprising:

an image forming portion for forming a toner image on a recording material;

a recording material feeding mechanism including (i) a rotatable endless belt perforated with numbers of holes and (ii) an air suction portion provided inside said belt, said air suction portion imparting negative pressure, through said belt, for sucking and holding the recording material on said belt, wherein said recording material feeding mechanism feeds the recording material on which the image is formed by said image forming portion, while sucking and holding the recording material on said belt on a recording material feeding side of said belt;

an infrared irradiating portion opposed to said belt on the recording material feeding side, said infrared irradiating portion having an infrared radiation member for heating the image by irradiating the recording material fed while being sucked and held on said belt with infrared radiation; and a controller for controlling operations of said recording material feeding mechanism and said infrared irradiating portion, wherein, in a standby operation sequence after power on of said image forming apparatus, said controller causes said air suction portion to start an air sucking operation after a lapse of a predetermined time with no error from a start of energization to said infrared irradiating portion.

3. The image forming apparatus according to claim 2, wherein the predetermined time is a time enough that a temperature of said infrared radiation member has reached a predetermined temperature after the start of energization to said infrared irradiating portion.

4. The image forming apparatus according to claim 1, wherein said image forming portion forms an unfixed image on the recording material with a liquid developer containing a liquid carrier of an ultraviolet curable type and toner, and wherein said image forming apparatus further comprises an ultraviolet irradiating portion for curing the liquid developer through irradiation, with ultraviolet radiation, of the recording material fed on said belt while being sucked and held on said belt, said ultraviolet irradiating portion being provided on a side downstream of said infrared irradiating portion with respect to the recording material feeding direction so as to oppose said belt on the recording material feeding side of said recording material feeding mechanism.

5. The image forming apparatus according to claim 1, wherein said air sucking portion includes a belt supporting plate provided so as to slide with an inner surface of said belt, said belt supporting plate being a flat plate perforated with numbers of holes.

* * * * *